US007278492B2

(12) United States Patent
Braddick

(10) Patent No.: US 7,278,492 B2
(45) Date of Patent: Oct. 9, 2007

(54) EXPANDABLE LINER HANGER SYSTEM AND METHOD

(75) Inventor: Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 321 days.

(21) Appl. No.: 11/138,838

(22) Filed: May 26, 2005

(65) Prior Publication Data

US 2005/0263294 A1 Dec. 1, 2005

Related U.S. Application Data

(63) Continuation-in-part of application No. 10/855,044, filed on May 27, 2004, now Pat. No. 7,225,880.

(51) Int. Cl.
*E21B 23/00* (2006.01)

(52) U.S. Cl. ..... 166/382; 166/208

(58) Field of Classification Search ..... None
See application file for complete search history.

(56) References Cited

U.S. PATENT DOCUMENTS 3,946,807 A * 3/1976 Amancharla et al. ..... 166/123
3,948,321 A 4/1976 Owen et al.
4,051,896 A * 10/1977 Amancharla et al. ..... 166/123
6,499,537 B1 * 12/2002 Dewey et al. ..... 166/255.1
6,705,395 B2 3/2004 Cook et al.
7,093,656 B2 * 8/2006 Maguire ..... 166/277
2001/0020532 A1 9/2001 Baugh et al.

* cited by examiner

*Primary Examiner*—Frank Tsay
(74) *Attorney, Agent, or Firm*—Browning Bushman P.C.

(57) ABSTRACT

A liner hanger assembly seals with casing 22 and supports a liner 90 within a well. The tubular liner hanger body 50 and a tubular expander 40 may be positioned downhole at a desired depth on a running tool. An actuator assembly 12, 24 may forcibly move the tubular expander 40 into the liner hanger body 50, expanding the liner hanger body to seal and secure the hanger body to the casing string 22. The running tool may be released from the set liner hanger by an axially movable collet mechanism, such as ratchet ring 92 and a catch mechanism, such as threads 94. The running string thus need not be rotated to release from the set liner hanger.

20 Claims, 3 Drawing Sheets

EXPANDABLE LINER HANGER SYSTEM AND METHOD

RELATED APPLICATION

This application is a continuation-in-part of U.S. Ser. No. 10/855,044 filed May 27, 2004 now U.S. Pat. No. 7,225,880.

FIELD OF THE INVENTION

The present invention relates to downhole tools and techniques for hanging a liner in a well. More particularly, the invention relates to forming an expandable liner hanger assembly for grippingly engaging a casing string to support the liner in the well. The running tool may be released from the set liner hanger without rotation of the work string.

BACKGROUND OF THE INVENTION

Various types of liner hangers have been proposed for hanging a liner from a casing string in a well. Most liner hangers are set with slips activated by the liner hanger running tool. Liner hangers with multiple parts pose a significant liability when one or more of the parts becomes loose in the well, thereby disrupting the setting operation and making retrieval difficult. Other liner hangers and running tools cannot perform conventional cementing operations through the running tool before setting the liner hanger in the well.

Other liner hangers have problems supporting heavy liners with the weight of one million pounds or more. Some liner hangers successfully support the liner weight, but do no reliably seal with the casing string. After the liner hanger is set in the well, high fluid pressure in the annulus between the liner and the casing may blow by the liner hanger, thereby defeating its primary purpose. Other liner hangers are not able to obtain burst and/or collapse characteristics equal to that of the casing. A preferred liner hanger maintains a collapse and burst strength at least substantially equal to that of both the casing and the liner.

Liner hangers having gripping elements and packing elements have been expanded to support a liner within the casing. Prior art designs have generally relied upon expansion of the tubular anchor from an elastic state to a plastic state in which the steel lost its fully elasticity or memory. The subsequent relaxation of the energy necessary to maintain the liner hanger at the fully expanded diameter may thus lead to a failure of sealing and/or suspension supporting capability.

Another significant problem with some liner hangers is that the running tool cannot be reliably disengaged from the set liner hanger. This problem with liner hanger technology concerns the desirability to rotate the liner with the work string in the well, then disengage from the work string when the liner hanger has been set to retrieve the running tool from the well. Prior art tools have disengaged from the liner hanger by right-hand rotation of the work string, although some operators for certain applications prefer to avoid right-hand rotation of a work string to release the tool from the set liner.

Publication 2001/0020532A1 discloses a tool for hanging a liner by pipe expansion. U.S. Pat. No. 3,948,321 discloses a reinforcing swage which remains downhole when the tool is retrieved to the surface. U.S. Pat. No. 6,705,395 discloses a radially expanded liner hanger which uses an axially movable annular piston to expand a tubular member.

The disadvantages of the prior art are overcome by the present invention, and an improved liner hanger system and method of setting the liner hanger are hereinafter disclosed.

SUMMARY OF THE INVENTION

The expandable liner hanger system and method achieves positioning, suspension, sealing and optional cementing of a liner in a subterranean well. In an exemplary application, the method involves expansion of a high strength steel tubular hanger body having slips and packing elements positioned about its outer circumference for contact with the inner surface of a casing string, which has a larger internal diameter than the initial external diameter of the liner and liner hanger.

The present invention preferably uses a tubular expander to expand the hanger body, and which remains positioned inside the expanded hanger body for support at its final expanded diameter, thus sandwiching the expanded plastically deformed hanger body between the casing and the tubular expander. This method provides improved sealing and gripping capability and requires shorter lengths of expandable tubular liner hanger, typically in the range of from one to two feet.

According to one embodiment of the invention, a liner hanger for use downhole in a wellbore is provided to seal with a casing string and transmit fluid between a liner supported on the liner hanger body and a production string extending upward from the liner hanger body. The tubular liner hanger body is removably supportable on a running tool for positioning the tubular liner downhole. A tubular expander is also removably supportable on the running tool, and has an expander outermost diameter greater than the initial hanger inner diameter. The running tool includes a plurality of actuators, such as pistons, which forcibly move the tubular expander axially from a position axially spaced from the tubular liner hanger body to a position substantially within the tubular liner hanger body, thereby radially expanding the hanger body against the casing string to secure the tubular expander and the tubular hanger body downhole. A sealing sleeve may be secured to an upper end of the tubular expander for communication between the tubular expander and a production string or liner extending upward to the surface.

The tubular liner hanger body may be axially interconnected with a running tool mandrel by a collet or other latch mechanism, which is prevented from moving radially inward by a stop when the liner is run in the well. The latch mechanism moves axially relative to the stop after the tubular expander is positioned within the liner hanger body and the work string is subsequently lowered. A catch mechanism interconnects the latch mechanism and the running tool mandrel, thereby allowing the latch mechanism to move radially inward and release the running tool from the set liner hanger without rotating the running string.

A method of hanging a liner in a well bore is also provided to seal with a casing string and transmit fluid between the liner and a production string extending upward from the liner hanger. In one embodiment, the method comprises positioning an expandable tubular liner hanger body and tubular expander on a running tool. After positioning the liner hanger at a selected depth within a wellbore, the tubular expander is forcibly moved axially to a position substantially within the tubular liner hanger to radially expand the tubular liner hanger against the casing string, thereby securing the tubular liner hanger and the tubular expander downhole. The work string is not rotated to release the plurality of actuators from the set liner hanger body and tubular expander.

As yet another feature, the running tool may include a central mandrel with a bore for passing cement through the running tool prior to setting the liner hanger. The running tool mandrel may also include a left hand thread for releasing the running tool by right hand rotation of the work string as a backup to the primary release mechanism, which does not require work string rotation.

Another feature is that the running tool actuator may be reliably released from the set liner hanger assembly after expansion of the liner hanger body without rotating the work string. Interference between the tubular expander and the liner hanger body secures the tubular expander within the liner hanger body. The running tool may then be removed from the well.

An advantage is that the liner hanger may be constructed more economically than other prior art liner hangers. The assembly consists of few components. A related advantage is that many of the components of the assembly, such as slips and packer seals, may be commercially available in accordance with various downhole conditions.

Another advantage is that the system for forming a liner hanger may utilize conventional components each with a high reliability. Existing personnel with a minimum of training may reliably use the liner hanger system according to this invention since the invention relies upon well known surface operations to reliably form the liner hanger.

These and further features and advantages of the present invention will become apparent in the following detailed description, wherein reference is made to the figures in the accompanying drawings.

DETAILED DESCRIPTION OF PREFERRED EMBODIMENTS

A liner may be conveyed into the well to the desired setting or suspension depth by a drill pipe or work string connected to a multi-stage, double action hydraulic setting and releasing tool (running tool) that furnishes the necessary forces to expand the liner hanger assembly into engagement with the casing. The running tool may be constructed of sufficiently high strength steel to support the weight of the liner as it is run into the well and to provide the necessary force to expand the liner hanger assembly. Additionally, the running tool preferably has a sufficiently large internal bore in its central mandrel to enable passage and displacement of cement for cementing the liner within the well bore.

Figure 1A:
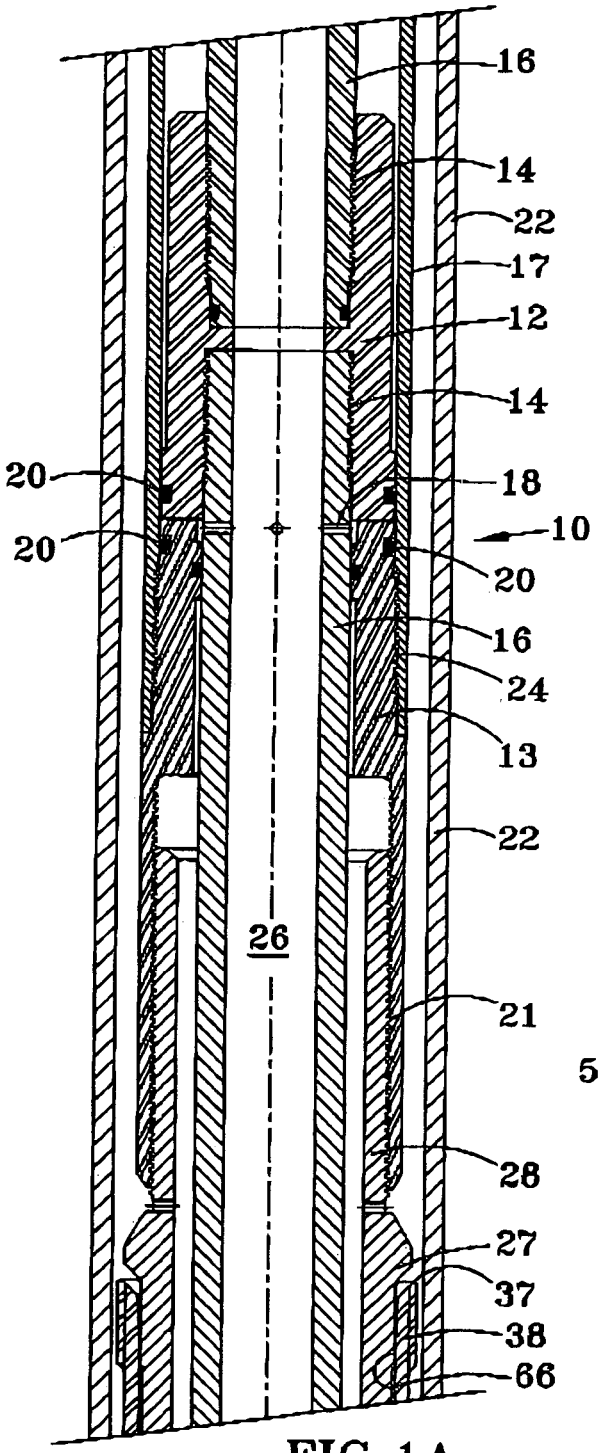
FIG. 1A depicts in cross section an upper actuator portion of the running tool.

Referring to FIG. 1A, the upper end of the running tool actuator assembly 10 may include a top connector 12 structurally connected by threads 14 to the running tool inner mandrel 16, which in turn is structurally at the lower end of a work string. A throughport 18 in the mandrel 16 below the top connector 12 allows fluid pressure within the interior of the running tool to act on both top connector 12 and a lower connector 13, which as shown includes conventional seals 20 for static sealing with one of the mandrel 16 and an outer sleeve 17, and for dynamic sealing with the other of the mandrel 16 and the outer sleeve 17. A predetermined amount of fluid pressure within the running tool acting on the lower connector 13 will thus provide downward movement of the outer sleeve 17 with a known force which is connected to the lower connector 13 by threads 24.

Fluid pressure to the top connector 12 thus passes through the throughport 18, and the top connector (top piston) 12 is sealed and structurally connected to the mandrel 16. Fluid pressure thus exerts an upward force on the connector 12 and thus the mandrel 16, and also exerts a downward force on the lower connector (lower piston) 13 and the outer sleeve 17.

The top connector (top piston), lower connector (lower piston), sleeve 17 and running tool mandrel 16 thus define a variable size hydraulic cavity. The throughport 18 passes through the running tool mandrel and thus is in fluid communication with the bore 26 in the mandrel 16. With the top inner connector 12 fixed to the mandrel 16 and the outer connector 13 fixed to the sleeve 22, fluid pressure introduced into the hydraulic cavity moves the sleeve 22 downward relative to the mandrel 16 to move the tubular expander 40 downward to expand the liner hanger body 50 (see FIGS. 1B and 1C). Those skilled in the art will appreciate that a series of top connectors, lower connectors, sleeves and mandrels may be provided, so that forces effectively "stack" to create the desirable expansion forces. Further details of an alternative actuator assembly are disclosed in U.S. Pat. No. 6,622,789. It is a particular feature of the present invention that a series of top and lower connectors may exert a force on the tubular expander in excess of 1,000,000 pounds of axial force, and preferably in excess of about 1,500,000 pounds of axial force, to expand the tubular anchor.

Still referring to FIG. 1A, a force transfer member 28 may be threaded to and move axially with the outer sleeve 17, or to another lower sleeve provided on the lowermost connector 13, so that the force transfer shoulder 27 on member 28 engages the top shoulder 37 on the sleeve 38 at the upper end of the tubular expander 40. Preferably, a lower shoulder 42 at the end of the force transfer sleeve 28 also engages a mating shoulder 39 at the lower end of sealing sleeve 38 to more reliably move the tubular expander 40 downward.

Figure 2A:
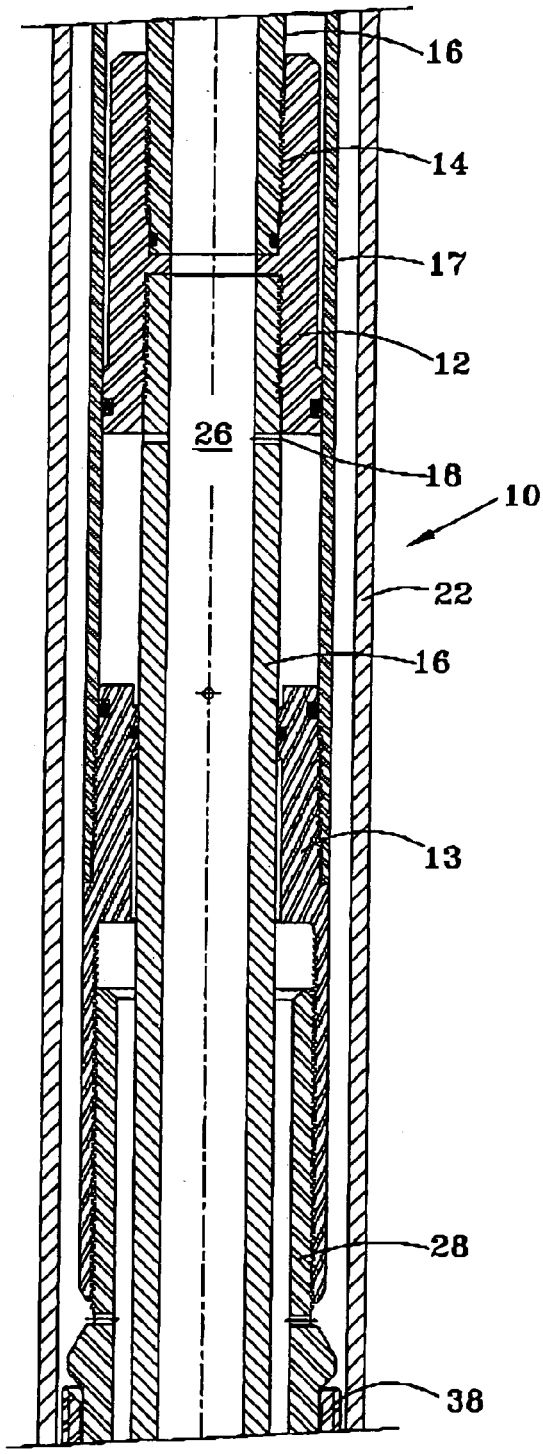
FIG. 2A depicts the actuator as shown in FIG. 1A stroked.
Figure 2B:
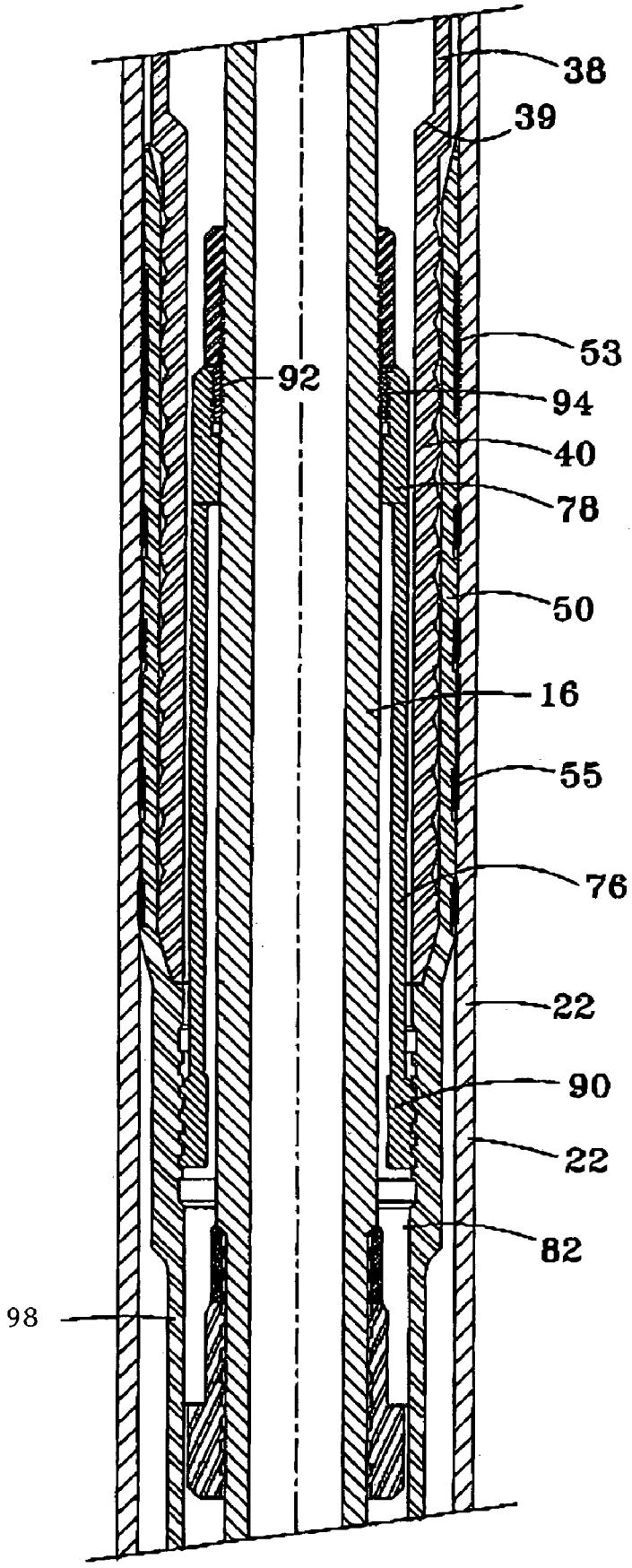
FIG. 2B depicts the liner hanger body substantially within the set expansion sleeve.

By hydraulically moving the force transfer member 28 downward, the tubular expander 40 is forcibly moved at least substantially within the liner hanger body 50 to radially move the liner hanger body 50 outward and into engagement with the casing string, as shown in FIG. 2B. The force transfer member or sleeve 28 may thus be positioned above the tubular expander, and moves or strokes the tubular expander downward to a position within the liner hanger body.

Figure 1B:
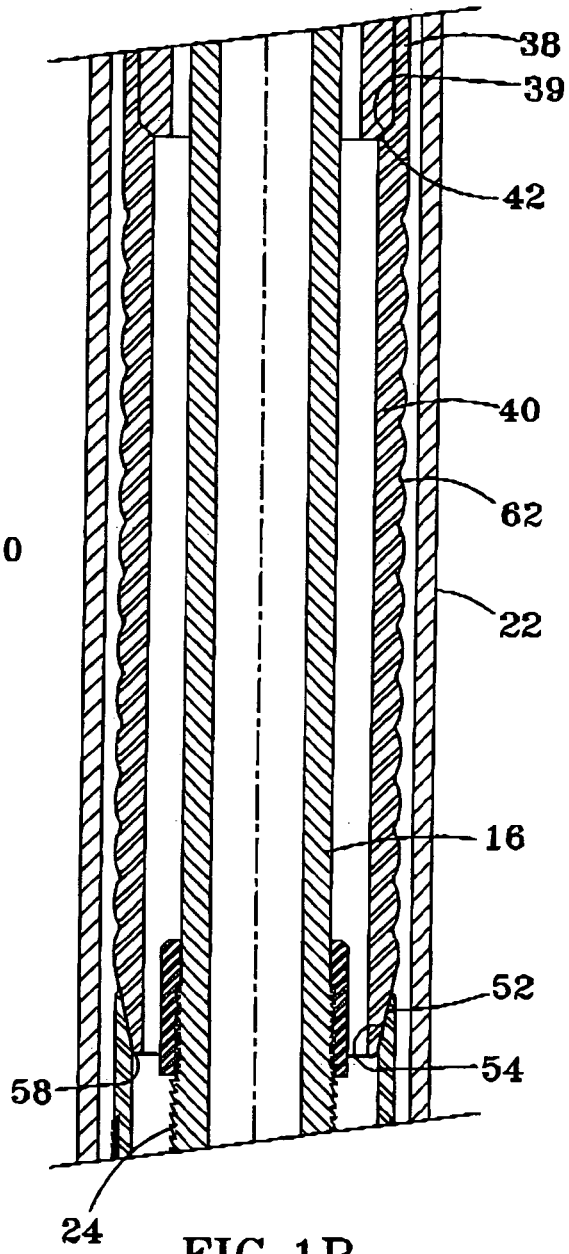
FIG. 1B depicts the expansion sleeve.

The sleeve-shaped tubular expander 40 acts as a setting sleeve which is adjustably supported on the force transfer member 28 and moves in a downward direction during the liner hanger setting operation. The force transfer member 28 may be adjusted axially with respect to the tubular expander 40 by adjusting thread 21 (see FIG. 1A) until the lower end of the tubular expander is in engagement with the upper end of the liner hanger body, such that the lower taper 52 on the tubular expander 40 as shown in FIG. 1B is in secure contact with the upper taper 54 on the liner hanger body 50.

The liner 98 (see FIG. 2B) may be run to setting depth on drill pipe and cemented in a conventional manner. The cement may be displaced from the drill pipe and liner and into the well bore/liner annulus using cement wiper plugs as is customary in the art. Once the plugs have displaced the cement and seated near the bottom of the liner, pressure may be applied to fluid within the work string and consequently through the pressure ports 18 of mandrel 16 and into the pressure chambers formed between upward moving pistons (connectors) and downward moving pistons (connectors). Pressure is increased until the force created is sufficient to cause the expander 40 to move downward, forcing the expander 40 into the upward facing receptacle of the liner hanger body 50. Forcing the expander 40 downward causes the liner hanger body 50 to expand radially outward, forcing slips 53 and sealing elements 55 into engagement with the inside surface of the casing 22, thus sealing and supporting the liner hanger within the casing.

If pressure within the drill pipe and liner cannot be increased after landing the wiper plugs, a setting ball may be dropped into the drill pipe and permitted to gravitate until the ball engages the seat at the lower end of the running tool. Pressure may then be increased to operate the setting tool as previously described.

The liner hanger body 50 is a tubular member preferably having elastomer, graphite or other suitable sealing elements 55 affixed about its outer circumference for sealing with the casing upon expansion of the liner hanger. A plurality of gripping members, such as slips 53, may be provided on the liner hanger for securing the liner hanger to the casing string upon expansion. The sleeve-shaped expander 40 is set substantially within the bore of the expanded body 50, and thus provides substantial radial support to the tubular body or anchor 50 once the running tool is returned to the surface. This increased radial support to the body or anchor desirably maintains fluid tight engagement between the liner hanger and casing string.

The liner hanger assembly includes a tubular anchor or expander body 50 and a tubular expander 40 preferably positioned above the tubular anchor when run in the well. The tubular expander has an expander outer diameter greater than the liner hanger inner diameter, such that moving the tubular expander into the liner hanger body will expand the liner hanger body against the casing string to seal the liner hanger body with the casing string and secure the liner hanger and the tubular expander downhole in the casing string. The tubular expander may initially be positioned above and rest on the hanger body prior to expansion, restraining axially downward movement of the tubular expander. The tubular body 50 and tubular expander 40 are each preferably solid rather than perforated or slotted.

Figure 1C:
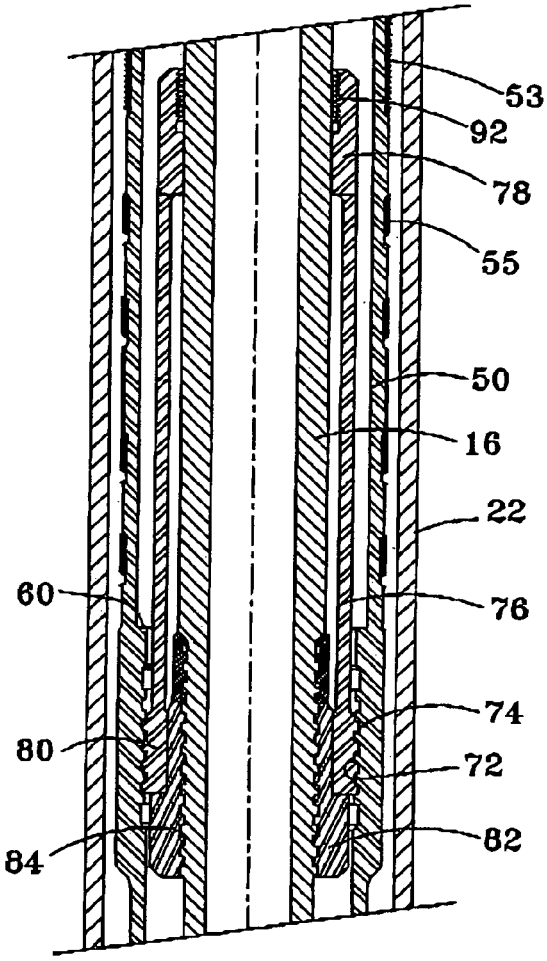
FIG. 1C depicts the liner hanger body prior to expansion.

Further downward movement of tubular expander 40 within the liner hanger body 50 is prohibited when shoulder 58 (see FIG. 1B) at lower end of tubular expander 40 engages stop surface 60 on the hanger body 50, as shown in FIG. 1C. This engagement at completion of the radial expansion process causes a spike in setting pressure as an indicator of completion of the expansion process. This position is shown in FIG. 2B. The running tool may then be retrieved, leaving the tubular expander positioned radially inward of and axially aligned with the liner hanger to maintain the liner hanger body in gripping engagement with the casing string.

One or more scallops, circular arcs or circular bumps 62 on the outside of the tubular expander 40 form a series of metal-to-metal ball seals that provide a gas tight seal between the set tubular expander 40 and set liner hanger body 50 assembly. The tubular expander preferably is a continuous sleeve-shaped member which radially supports the liner hanger body once expanded. The OD and ID of the expander is substantially constant along its length (except for the annular bumps), thereby reducing the likelihood that the expander will slide out from under the set liner hanger after the running tool is retrieved to the surface.

The upper end of the tubular expander 40 may have an upward facing sealing sleeve 38 (see FIGS. 1A and 1B) with an internal sealing surface 66 suitable for receiving a tie-back seal nipple after the liner is installed in the well. The tubular expander body 40 may thus be positioned within the liner hanger body 50 to expand the liner hanger, while the upper sleeve 38 integral with and above the tubular expander body may be used for sealing with a seal nipple for extending the liner upward.

The hydraulic running tool may be connected to internal threads 72 on the liner hanger body 50 by external threads 74 on releasable collet fingers 76. The collet fingers extend from collet ring 78 surrounding the running tool mandrel 16. In the running position, the collet fingers lower ends 80 are prevented from flexing radially inwardly by the nut 82 that is threadably connected to mandrel 16 by a left hand thread at 84. The mandrel 16 of the running tool moves in an upward direction during setting of the liner hanger slips, and becomes stationary once the slips are set. Continued application of pressure within the setting tool moves the tubular expander 40 further into the hanger body 50.

The foregoing setting operation causes the upward moving pistons (connectors) 12 and the lower moving pistons (connectors) 13 to stroke or separate from one another as the tubular expander 40 is moved into the hanger body 50 to set the liner hanger. Thereafter, the drill pipe may be lowered to collapse the setting stroke causing the mandrel 16 to move downward relative to the collet ring 78. This downward movement causes threads 74 on the mandrel 16 to move from an axially spaced position to an engaged position with a ratchet mechanism 92 on the collet ring 78 retained in the hanger body 50 by external threads 74 on collet fingers 76. The downward movement of the mandrel 16 additionally causes the nut 82 to be moved from its running and setting position, supporting the lower ends 80 of collet fingers to an axially spaced position below the collet fingers, as shown in FIG. 2B. The running tool may thus be retrieved by merely pulling up on the mandrel 16, allowing the collet fingers 76 to move radially inward and disengage from the threads 74. It is thus a feature of the invention that the running tool may be retrieved without right hand rotation of the work string or the mandrel 16.

The actuator assembly of the running tool may alternatively be removed by unthreading the threaded connection 84. The left-hand threaded connection 84 may thus be a backup to preferred disconnection as discussed above, which does not require work string rotation. Upon unthreading by right hand rotation of the work string, the nut 82 is then free to fall and move from its position supporting the inner surface of the collet fingers 76. The nut 62 may be caught on a lower coupling. Upward force applied to the collet ring then causes the collet fingers 76 to flex inwardly, moving external threads on the collet fingers from engagement with the internal threads of the liner hanger body. The running tool is then free to be removed from the set liner hanger.

FIG. 2A depicts the actuator assembly 10 stroked to move the tubular expander 40 within the liner hanger body 50. Compared to the FIG. 1A view, the upper connector or upper piston 12 and the mandrel 16 axially secured thereto have moved upward in response to fluid pressure passing through the port 18 and into the chamber between the pistons and between the mandrel and the outer sleeve 17. The lower connector or lower piston 13 axially secured to the outer sleeve 17 has moved downward relative to the mandrel 16, creating a fluid chamber between the bottom of the upper connector 12 and the top of the lower connector 13.

FIG. 2B depicts set liner hanger body 50 with the tubular expander 40 therein and the lower end of the sealing sleeve 38 integral with the tubular expander 40 and extending upward from the tubular expander. A seal nipple may be inserted into the upper sealing sleeve portion 38 of the tubular expander 40, until a shoulder of the seal nipple contacts the seating surface 79, as shown in FIG. 2B. The sealing sleeve 38 is preferably integral with the upper end of tubular expander 40, and preferably has a polished cylindrical inner surface for sealing with a cylindrical outer surface of the seal nipple. The seal nipple may also include an elastomeric seal, such as a Chevron seal stack, for sealing with the cylindrical inner surface of the sealing sleeve. The seal nipple may also be furnished with one or more external metal-to-metal ball seals for metal-to-metal sealing engagement with an inner surface of a sealing sleeve. The sealing bumps alternatively could be provided on the ID of the liner hanger body, although providing the bumps on the tubular expander may be less costly to manufacture.

The method of setting a liner hanger according to this invention within a well is a considerable improvement over prior art hangers because radial expansion of the liner hanger body effectively closes off the annular gap between the casing and the liner, providing high pressure integrity at the top of the liner that is conventionally equal to the lesser of either the casing or the liner. Liner suspension capacity can be increased without sacrificing annular flow area by increasing the surface area of the low profile slips. Both the improvement in pressure integrity and suspension rating provide long term effect because of the expander continuously supports the liner hanger body. The running tool is released from the set liner hanger assembly without requiring right hand rotation of the work string.

Latch mechanisms other than collet mechanisms may be used to selectively interconnect the liner hanger body with the running tool mandrel. A keeper ring may alternatively be used to selectively engage and disengage a groove to serve this function. Another type of catch mechanism may include one or more radially movable dogs each for fitting within a slot.

Another feature of the expandable liner hanger is that there are no moving parts on the liner hanger that may become disengaged from the liner hanger body during installation of the liner in the well, thereby making it difficult or impossible to get the liner to the required setting depth. For that reason, the expandable liner hanger is particularly desirable for its adaptation for use in liner drilling operations. This is a technique for drilling the well by positioning a drill bit at the bottom of the liner and rotating the drill pipe (work string) and liner to drill the liner into the well. In order to drill the liner into the well, relative rotation is prohibited between the liner and the running tool and drill pipe during this operation. However, relative rotation between the running tool and the liner after the liner is drilled into position and suspended from the casing is permitted in order to effect release of the running tool from the set liner hanger. Also, this technique may be used apart from a drilling position to rotate the liner and thereby more easily insert the liner into a deviated well. Liner rotation may be achieved with the use of dogs as disclosed in U.S. Ser. No. 10/855,044. Those skilled in the art appreciate that only the upper portion of a liner 98 is shown in FIG. 2B. A typical liner may extend downward hundreds of feet or more from the body 50.

The assembly may include one or more dogs each for engaging a slot in the liner to rotatably lock the one or more dogs to the liner. A clutch selectively engages and disengages rotation between a running tool mandrel and the one or more dogs, such that the liner rotates with the running tool mandrel when the clutch is engaged and the liner is rotationally disconnected from the running tool mandrel when the clutch is disengaged. Further details regarding this technique are disclosed in the parent application, and are incorporated by reference herein.

A particular feature of the present invention is that the running tool includes a sufficiently large bore to allow for the reliable passage of cement and one or more cementing plugs to pass through the bore of the running tool and cement the liner in place. Cement may thus be pumped from the surface through the work string and through the liner hanger, then out the lower end of the liner and into the annulus between the liner and the borehole. Once the proper amount of cement is pumped into location, the liner hanger may be set.

As disclosed herein, the tubular expander is positioned at least partially within the hanger body, thereby radially expanding at least part of the liner hanger body. In other cases, all or substantially all of the tubular expander will be within the liner hanger body when the assembly is set. Complete insertion of the tubular expander within the liner hanger body is not required, however, for all applications.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A liner hanger and running tool assembly for use downhole in a wellbore to seal with a casing string and support a liner on the liner hanger, the liner hanger and running tool assembly comprising:

a tubular liner hanger body removably supportable on a running tool for positioning the liner downhole, the tubular liner hanger body having an initial hanger outer diameter less than an inner diameter of the casing string, the tubular liner hanger body being radially expandable by the running tool to seal with the casing string;

a tubular expander removably supportable on the running tool, the tubular expander having an expander outer diameter greater than an initial hanger body inner diameter;

the running tool including one or more actuators for forcibly moving the tubular expander axially from a position axially spaced from the tubular liner hanger body to a position substantially within the tubular liner hanger body, thereby radially expanding the tubular liner hanger body against the casing string to secure the tubular expander and the tubular liner hanger body downhole;

the tubular liner hanger body axially interconnected with a running tool mandrel by a collet mechanism, the collet mechanism being prevented from moving radially inward by an annular stop when the liner hanger is run in the well;

the annular stop moving axially relative to the collet mechanism after the tubular expander is positioned at least partially within the liner hanger body to expand the liner hanger body; and a catch mechanism for interconnecting the collet mechanism and the running tool mandrel when the tubular expander is positioned at least partially within the liner hanger body, thereby allowing radially inward movement of the collet mechanism to release the running tool from the set liner hanger.

2. A liner hanger and running tool assembly as defined in claim 1, wherein the running tool has an internal bore for passing cement through the running tool and out a lower end of the liner.

3. A liner hanger and running tool assembly as defined in claim 1, wherein the catch mechanism includes a ratchet ring on one of a collet mechanism and the running tool mandrel and ratchet threads on the other of the collet mechanism and the running tool mandrel.

4. A liner hanger and running tool assembly as defined in claim 3, wherein the ratchet ring is supported on the collet mechanism.

5. A liner hanger and running tool assembly as defined in claim 1, wherein the annular stop includes a left hand thread for releasing the running tool from the set liner hanger body by right hand rotation of the work string.

6. A liner hanger and running tool assembly as defined in claim 1, further comprising:

one or more packer seals on the tubular liner hanger body for sealing with the casing string upon expansion of the tubular liner hanger body; and a plurality of slips fixed on the tubular liner hanger body for securing the tubular hanger body to the casing string when the tubular liner hanger body is expanded by the tubular expander.

7. A liner hanger and running tool assembly as defined in claim 1, wherein the tubular expander is sealed to the tubular liner hanger by a plurality of annular bumps on an outer surface of the tubular expander.

8. A liner hanger and running tool assembly as defined in claim 1, wherein the tubular expander has a generally cylindrical exterior surface along an axial length of the tubular expander, such that the tubular liner hanger is expanded substantially the same amount along the axial length of the tubular expander.

9. A liner hanger and running tool assembly as defined in claim 1, wherein a stop on the tubular liner hanger body limits axial movement of the tubular expander with respect to the tubular liner hanger body.

10. A liner hanger and running tool assembly for use downhole in a wellbore to seal with a casing string and support a liner on the liner hanger, the liner hanger and running tool assembly comprising:

a liner hanger body removably supportable on a running tool for positioning the liner downhole, the liner hanger body supporting the liner in the well;

a tubular expander removably supportable on the running tool, the tubular expander having an expander outer diameter greater than an initial hanger body inner diameter;

the running tool including one or more actuators for forcibly moving the tubular expander axially from a position substantially axially spaced from the tubular liner hanger to a position within the tubular liner hanger, thereby radially expanding the tubular liner hanger body against the casing string to secure the tubular expander and the liner hanger body downhole;

the tubular liner hanger body axially interconnected with a running tool mandrel by a latch mechanism, the latch mechanism being prevented from moving radially inward by an annular stop when the liner hanger is run in the well;

the annular stop moving axially relative to the latch mechanism after the tubular expander is positioned at least partially within the liner hanger body; and a catch mechanism for interconnecting the latch mechanism and the running tool mandrel after the tubular expander is positioned at least partially within the liner hanger body, thereby allowing radially inward movement of the latch mechanism to release the running tool from the set liner hanger.

11. A liner hanger and running tool assembly as defined in claim 10, wherein the catch mechanism includes a ratchet ring on one of a collet mechanism and the running tool mandrel and ratchet threads on the other of the collet mechanism and the running tool mandrel.

12. A liner hanger and liner hanger assembly as defined in claim 10, wherein the annular stop includes a left hand thread for releasing the running tool from the set liner hanger body by right hand rotation of a work string.

13. A liner hanger and liner hanger assembly as defined in claim 10, wherein the tubular expander is sealed to the tubular liner hanger by one or more annular bumps on an outer surface of the tubular expander, and the tubular expander has a generally cylindrical exterior surface along an axial length of the tubular expander, such that the tubular liner hanger is expanded substantially the same amount along the axial length of the tubular expander.

14. A liner hanger and running tool assembly as defined in claim 10, wherein the running tool includes a central mandrel with a bore for passing cement through the running tool prior to setting the liner hanger.

15. A method of hanging a liner in a well bore to seal with a casing string, the method comprising:

positioning an expandable tubular liner hanger body and tubular expander on a running tool, the tubular liner hanger body having an initial liner hanger inner diameter, and an initial liner hanger outer diameter less than an inner diameter of the casing string, the tubular expander having an expander outer diameter greater than the initial liner hanger inner diameter;

positioning the liner hanger body at a selected depth within a wellbore from a work string;

forcibly moving the tubular expander axially to a position substantially within the tubular liner hanger body to radially expand the tubular liner hanger body against the casing string, thereby securing the tubular liner hanger body and the tubular expander downhole;

axially interconnecting the tubular liner hanger with a running tool mandrel by a latch mechanism prevented from moving radially inward when the liner hanger is run in the well;

axially moving a stop relative to the latch mechanism after the tubular expander is positioned at least partially within the set liner hanger body; and disengaging the latch mechanism after the tubular expander is positioned at least partially within the liner hanger body, thereby allowing radially inward movement of the latch mechanism to release the running tool from the set liner hanger body.

16. A method as defined in claim 15, further comprising: providing a ratchet ring on one of the latch mechanism and a running tool mandrel, and providing ratchet threads on the other of the latch mechanism and the running tool mandrel.

17. A method as defined in claim 15, further comprising: sealing the tubular expander to the tubular liner hanger body by a plurality of annular bumps on an outer surface of the tubular expander.

18. A method as defined in claim 15, further comprising: providing one or more packer seals on the tubular liner hanger body for sealing with the casing string upon expansion of the tubular liner hanger body; and fixing a plurality of slips on the tubular liner hanger body for securing the tubular hanger to the casing string when the tubular liner hanger body is expanded by the tubular expander.

19. A method as defined in claim 15, further comprising: positioning the tubular expander above the tubular liner hanger body prior to forcibly moving the tubular expander substantially within the tubular liner hanger body.

20. A method as defined in claim 15, further comprising: passing cement through the liner when the liner hanger body is set to cement the liner in the well bore.

* * * * *